United States Patent [19]

Low

[11] 4,354,579

[45] Oct. 19, 1982

[54] APPARATUS FOR GUIDING LIFT TRUCK MAST SEGMENTS

[76] Inventor: Leonard J. Low, P.O. Box 1927, Sparks, Nev. 89431

[21] Appl. No.: 164,248

[22] Filed: Jun. 30, 1980

[51] Int. Cl.[3] ..... B66B 7/02

[52] U.S. Cl. ..... 187/95; 308/3 B

[58] Field of Search ..... 187/9 R, 9 E, 95, 1 R; 308/3 B, 3 R, 244, 6 R; 182/195, 207; 212/269, 268, 267, 230, 231

[56] References Cited

U.S. PATENT DOCUMENTS

| | | | |
|---|---|---|---|
| 2,253,095 | 8/1941 | Rothweiler | 308/6 R |
| 3,199,642 | 10/1965 | Anderson | 187/95 |
| 3,556,247 | 1/1971 | Shinoda | 187/95 |
| 3,605,950 | 9/1971 | Goodacre | 308/6 R |
| 3,856,117 | 12/1974 | Solymas | 187/95 |
| 4,060,151 | 11/1977 | Chelin et al. | 187/95 |

FOREIGN PATENT DOCUMENTS

| | | | |
|---|---|---|---|
| 1287949 | 9/1972 | United Kingdom | 187/95 |

*Primary Examiner*—F. J. Bartuska
*Assistant Examiner*—Kenneth Noland
*Attorney, Agent, or Firm*—Herbert C. Schulze

[57] ABSTRACT

This is a unique mast roller as is used by lift trucks, and the like. It is characterized by a number of roller assemblies which are both removable and adjustable to compensate for variations in spacing between channel track members brought about by manufacture and by wear. Shims of different sizes can be inserted to compensate for this variation and said shims are of a configuration to allow fastening members to be removably installed. The plates supporting the rollers in this assembly are of a construction so as to provide adequate bearing surfaces for side movement between the channel guide members.

1 Claim, 9 Drawing Figures

40
50
3
30
13
14
17
20
60b
62
64
60a
60c
51
35
34
60
70
52
53
57
54
55
56
59b
59
59a
50a

APPARATUS FOR GUIDING LIFT TRUCK MAST SEGMENTS

CROSS-REFERENCE TO RELATED PATENT APPLICATIONS

This application is unrelated to any other patent applications filed by me.

BACKGROUND OF THE INVENTION

1. Field of the Invention

This invention is in the general field of bearing assemblies being used in mast rollers, and is more particularly directed to masts used in conjunction with lift trucks.

2. Description of the Prior Art

There are so many mast roller assemblies used in lift trucks, and the like, that it is virtually impossible to attempt to cover the field of the prior art. Those skilled in the art, however, are familiar with the numerous different types of roller assemblies.

Mast roller assemblies customarily are welded or otherwise permanently secured to the channel guide members.

The present invention is unique and distinct from prior inventions in this field, and particularly in the field of mast rollers, in that the roller assemblies installed onto said masts are both removable and adjustable to compensate for variations in construction of the masts and for wear.

SUMMARY OF THE INVENTION

I have been long involved in the design and production of industrial lift trucks. I have become well acquainted with the masts that are used in lift trucks that are designed to raise loads smoothly and efficiently from the ground to levels necessary for stacking and for loading onto trucks and other carriers.

In general, lift truck masts are supplied with roller assemblies to smoothly allow the movement of one mast segment in cooperation with another.

A major problem, however, is that the customary lift truck masts are not designed so as to be easily repaired or replaced. One of the principal difficulties in replacing or repairing such roller assemblies is the fact that they have been mounted onto permanent shafts which have been welded or otherwise secured to the track members. The limitations of such construction are well known in the art and, among other things, great loss of operating time and repair time results in high operating costs.

It must be understood that the usual nature of the mast assemblies, carrying great weights, in conditions of dirt and grime provides for much wear in equipment. To disassemble this equipment after repairs have been started takes a lot of time and expense and is also very dangerous to personnel.

After considerable experimentation and study, I have developed a most superior mast roller assembly for lift trucks, and the like, which provides for a maximum of efficiency and safety in replacing and adjusting such roller assemblies.

Among other things, it is to be noted that instead of replacing complete roller assemblies, I have also provided for easy insertion of spacer shims to make the adjustments more quickly.

After having fully developed the mechanism. I have now extensively tested and have ultimately made refinements which has resulted in a most unique mast roller assembly capable of totally unusual and unexpected results in the lift truck industry.

It is an object of this invention to provide a mast roller assembly for lift trucks wherein there is easy access to the removal and adjustment of the mast roller in relation to variations in construction of parts moving along side other parts and for compensation for wear factors.

Another object of this invention is to provide a mast roller bearing assembly which will take a side load of moving parts relative to one another in a manner which has the least wear.

Another object of this invention is to provide such a mast roller assembly as herein described wherein a minimum of wearing parts is involved for maximum life.

Another object of this invention is to provide such a device as herein described which is capable of withstanding the rigors of heavy load bearing stresses and for use on uneven terrain.

The foregoing and other objects and advantages of this invention will become apparent to those skilled in the art upon reading the description of a preferred embodiment in conjunction with a review of the appended drawings.

DESCRIPTION OF A PREFERRED EMBODIMENT

Figure 1:
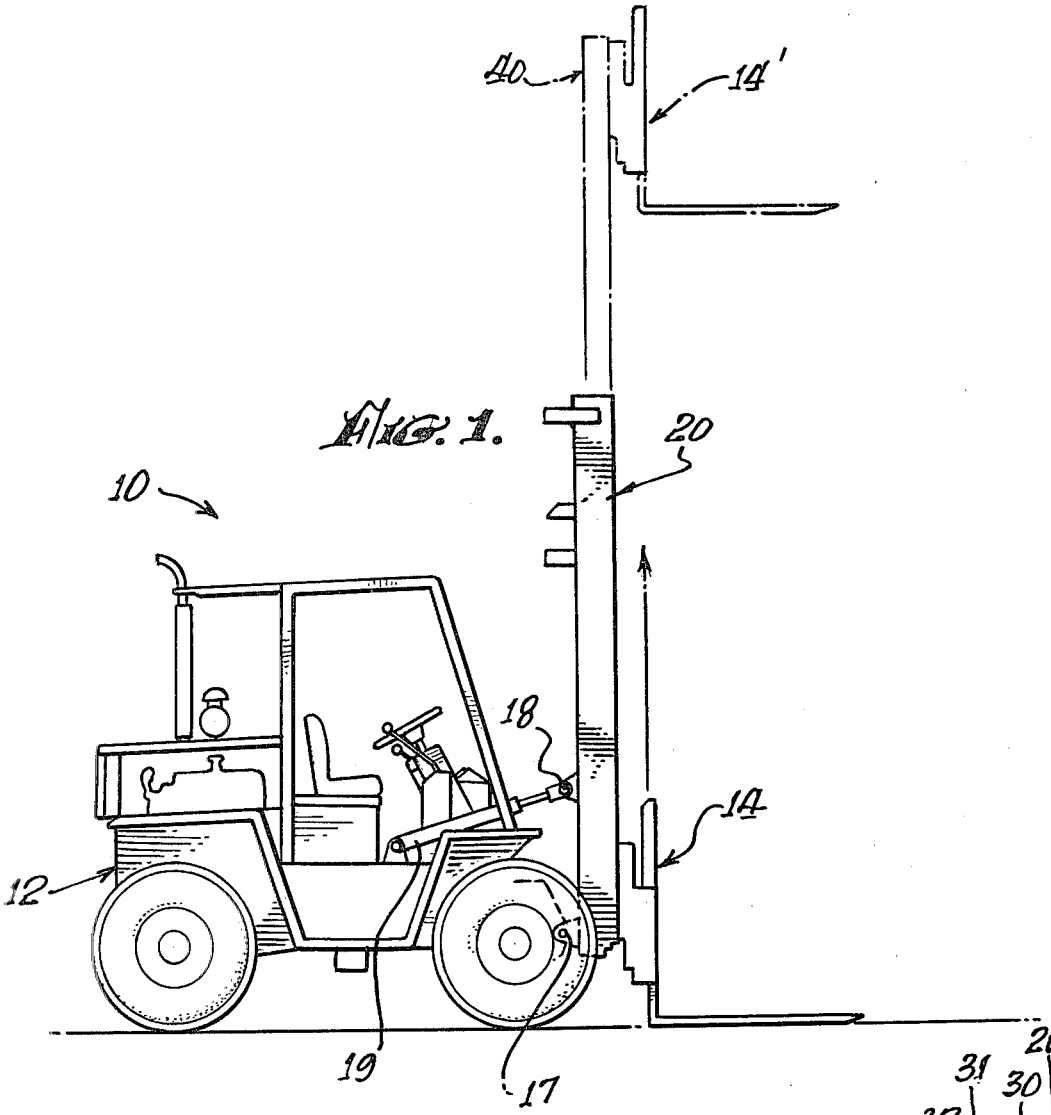
FIG. 1 is a side elevation view of a lift truck using a multiple mast assembly which employs the principles of this invention.

In the drawings, FIG. 1 illustrates a lift truck with a multiple stage mast assembly which utilizes the replaceable ball bearing roller assemblies of this invention.

The truck, generally indicated by the reference numeral 10, comprises a truck body 12, a mast assembly 13 and a fork lift mechanism 14, as will be understood by those skilled in the art.

Figures 2, 4, 5:
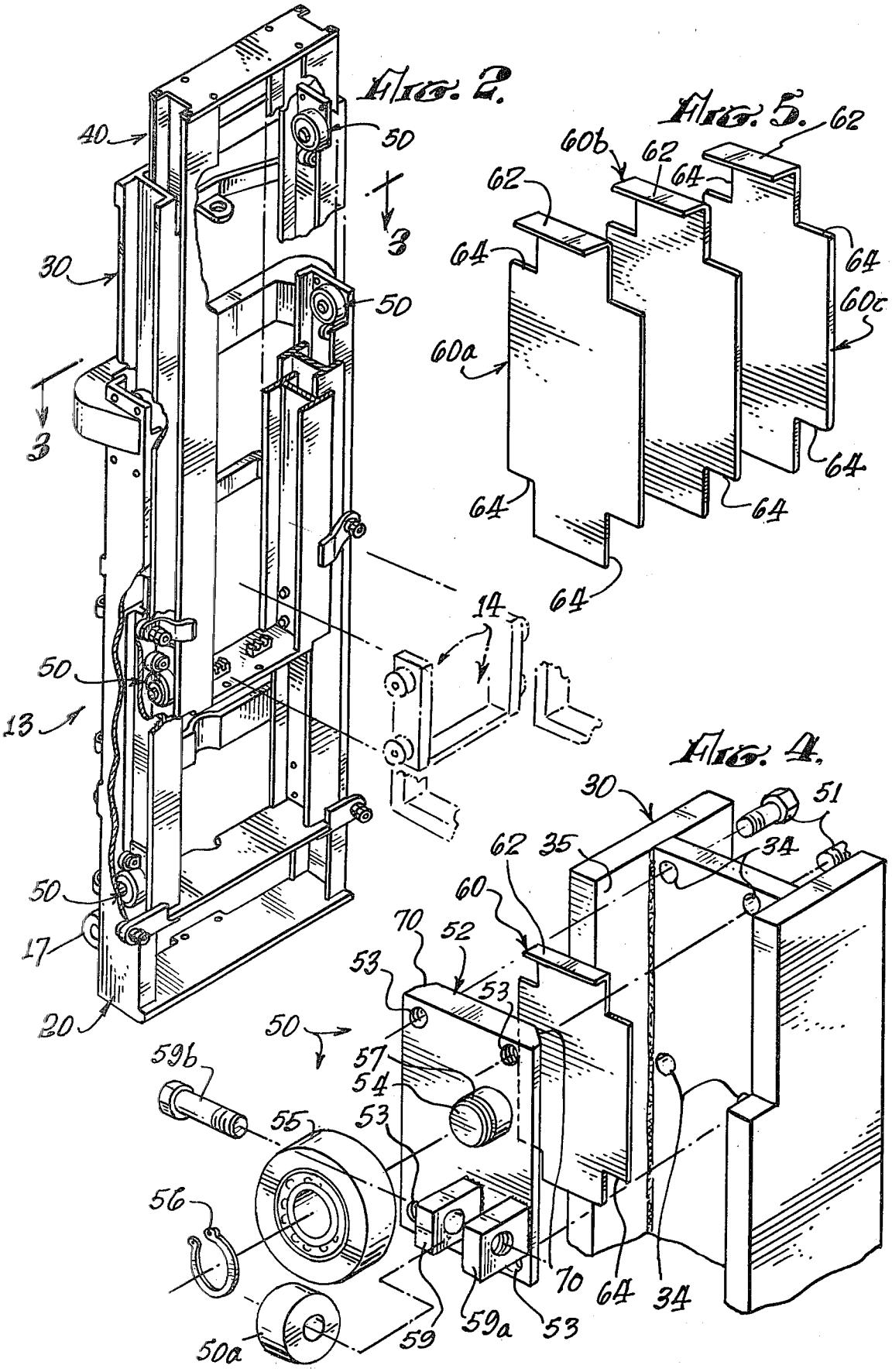
FIG. 2 is an enlarged perspective view of the mast assembly of FIG. 1 with portions broken away for clarity.
FIG. 4 is an exploded perspective of the components of the roller assemblies in FIG. 3.
FIG. 5 is a perspective view of different types of shims used in the roller bearing assembly.

The mast assembly 13 is pivotally mounted to the frame of the truck at 17 and is pivotally connected at 18 to a tilt cylinder assembly 19. In the perspective of FIG. 2 I have shown a three stage mast assembly wherein the outer frame assembly 20 has an intermediate frame assembly 30 cooperating with an innermost frame assembly 40. Within the frame 40, the fork mechanism 14 can move upwardly until it reaches the phantom line position indicated in FIG. 1 by the reference numeral 14'.

The relative movement between the mast frame assemblies 20, 30, and 40 is accomplished by means of a number of bearing assemblies 50. In the cross-section of FIG. 3 I have shown a number of these bearings as they would be placed between the outer, intermediate and inner frame assemblies of the mast. It can be readily seen that the bearing assemblies can be manufactured as left and right units, one being the mirror image of the other.

Figure 3:
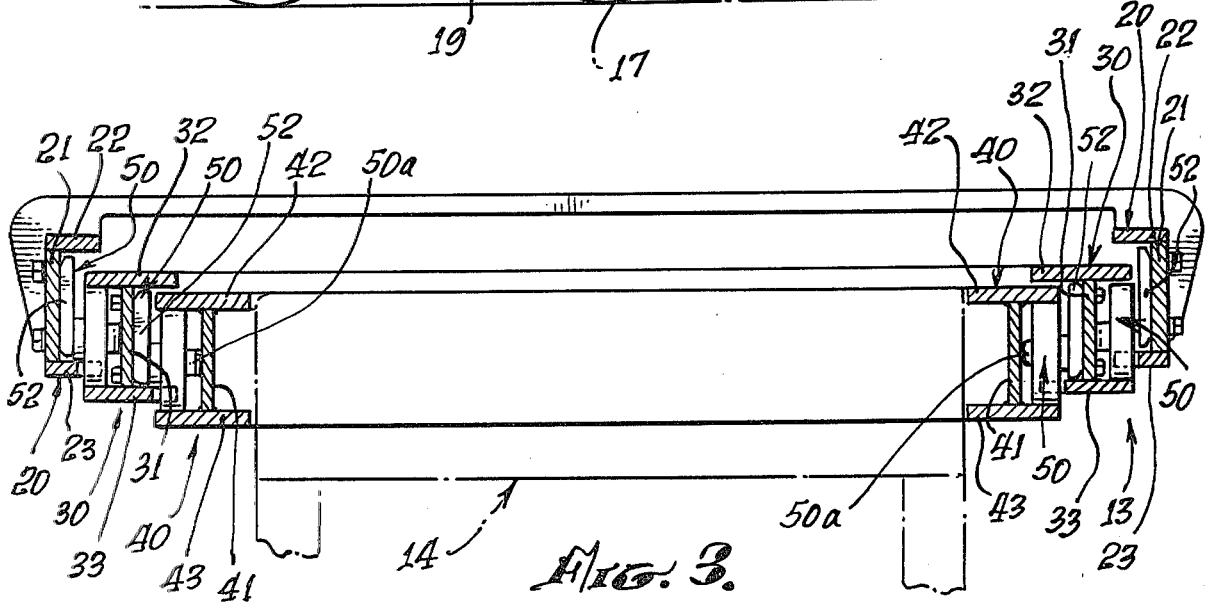
FIG. 3 is a further enlarged sectional view taken on line 3—3 of FIG. 2 showing the nested I-Beam construction with replaceable ball bearing roller assemblies.

Referring now to the cross section of FIG. 3, the mast frames are constructed by providing a central plate for each beam designated by the reference numerals 21, 31 and 41, respectively, and having side plates 22 and 23, 32 and 33 and 42 and 43. When all these plates are welded together it can be seen that the innermost frame becomes an I-Beam cross section, the intermediate frame an I-Beam construction, and the outer frame a C-Beam cross section. The FIG. 4 perspective shows the various components comprising a bearing assembly 50 as it would be mounted to an I-Beam section of either frame 20 or 30. For clarity of description, we shall refer to only one beam, particularly the beam 30. In beam 30 as indicated in FIG. 4 openings 34 are provided in center plate 31 in order to allow fasteners 51 to pass through and firmly retain base plate 52 within the channel 35 formed in I-Beam 30. Threaded openings 53 in base plate 52 allow fasteners 51 to accomplish this means. A stub shaft 54 is welded onto plate 52 providing a mounting for roller bearing unit 55. Bearing 55 is retained onto the shaft by snap ring 56 fitting into groove 57 of the stub shaft.

A second roller, acting as a bearing, indicated by the reference numeral 50*a* is supported between brackets 59 and 59*a* by insertion of a bolt member 59*b*. A spacer shim 60 of a configuration shown can be inserted between the plate 52 and the wall 31 in order to bring the roller 58 in closer contact with a corresponding inner surface of an adjacent frame central wall portion, if necessary.

In the FIG. 5 perspective I have shown three separate shims indicated by the reference numeral 60*a*, 60*b*, and 60*c*. Any number of combinations of each shim or with another shim can determine the spacing needed in order to make the roller assembly perform in a proper manner. Thickness of shim 60*a* can be used by itself or combined with thickness 60*b* or thickness 60*c* as indicated in the other shims. Each shim is provided with a horizontally oriented tab 62 in order to keep the shim from slipping downwardly when being installed and each shim is provided with notched out portions 64 in order to offer clearance for fasteners 51. Thus it can be seen that I have provided a very simple problem free method of roller adjustment.

Figure 6:
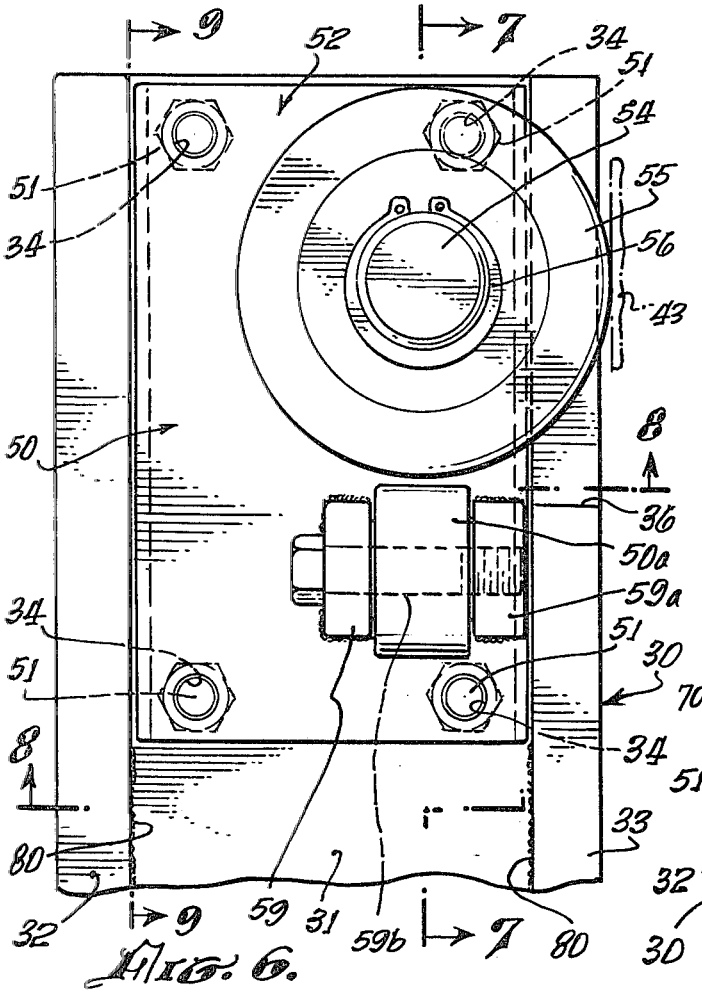
FIG. 6 is an enlarged elevational view of the right side replaceable ball bearing roller assembly of the mast unit of FIG. 2.
Figure 7:
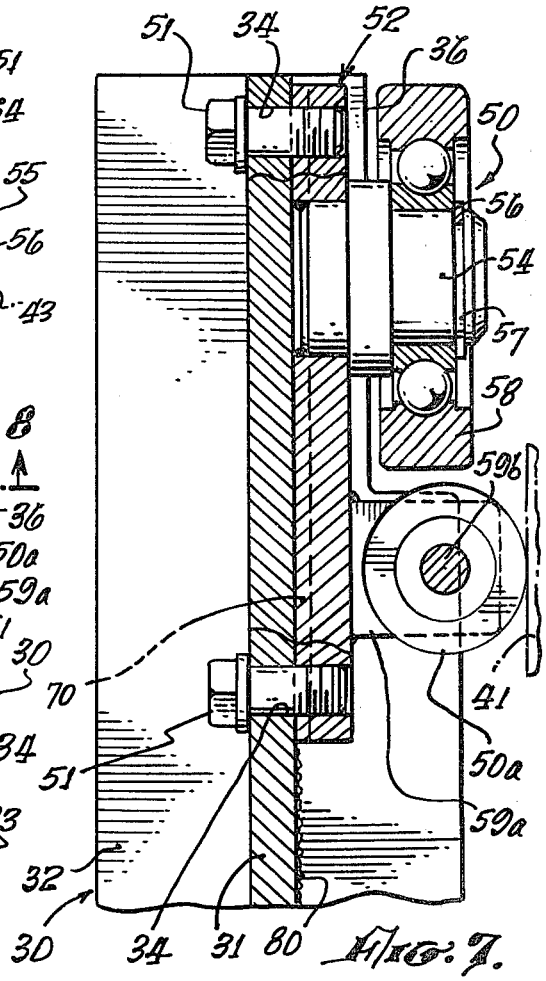
FIG. 7 is a sectional view taken on line 7—7 of FIG. 6 with certain parts shown in elevation.
Figure 8:
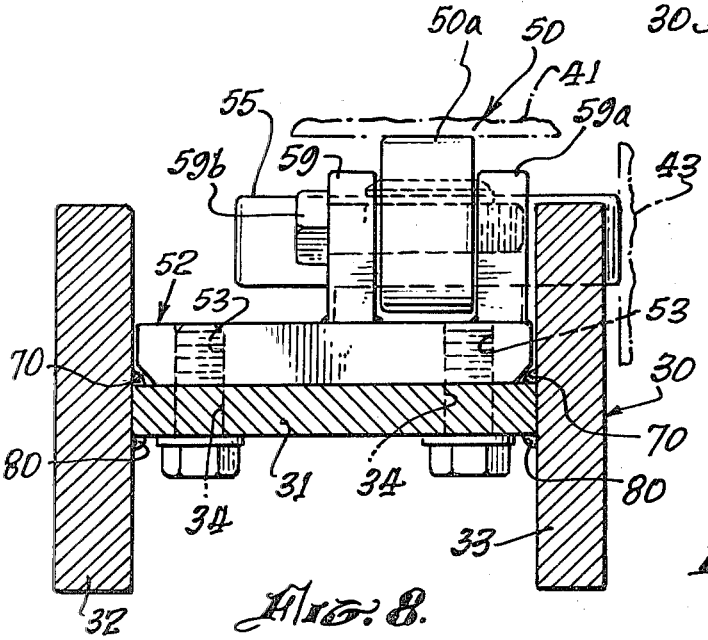
FIG. 8 is a section taken on line 8—8 of FIG. 6.

In FIG. 6 through 8 I have shown some enlarged views of the roller assembly 50 and referring especially to the cross section of FIG. 8 it is noted that the plate 52 is provided with cutaway or chamfered edges 70. These edges being cut away in this manner allow the plate to rest more positively against the central web 31 without being interfered with by the weldments 80. A very important feature of this base plate 52 is the fact that a zone or flat area indicated by the small letter "d" is provided in order to give a bearing edge to the plate 52 to better handle side thrust forces created by the roller bearing 55 against an adjacent frame member. A notched away portion 36 provided in the side wall 33 of frame member 30 allows clearance for the roller 55 to be able to be positioned in the manner in FIG. 6, so as to contact a plate of an adjacent frame member wall.

Figure 9:
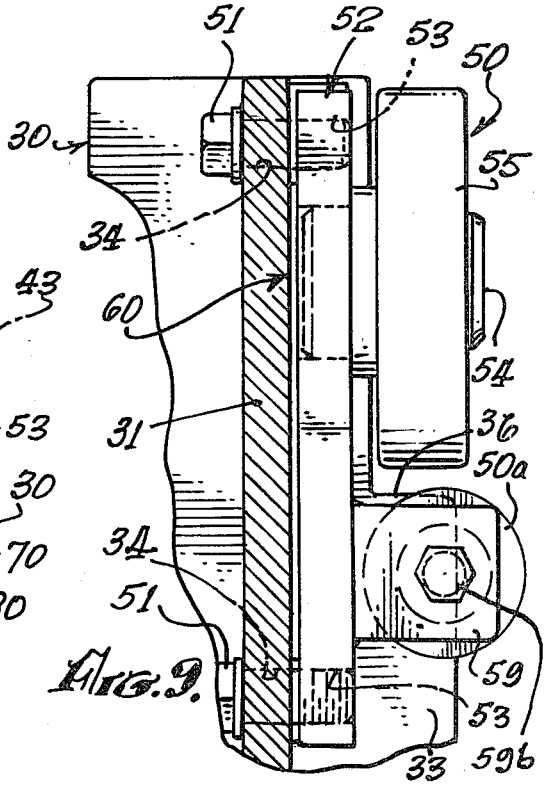
FIG. 9 is a sectional view taken on line 9—9 of FIG. 6.

FIG. 9 is a view similar to FIG. 7 showing one of the shims heretofore referred to in position to move roller 58 further out toward a contact face.

Obviously, numerous variations will be possible by those skilled in the art when once understanding the fundamentals of this invention, and while the embodiments as shown are fully capable of achieving the objects and advantages desired, it is to be understood that such embodiments have been for purposes of illustration and not for purposes of limitation.

I claim:

1. An apparatus for guiding lift truck mast segments comprising: a first lift truck mast segment, having a removable roller bearing assembly means mounted thereon, said roller bearing assembly means comprising a flat mounting plate secured to said first lift truck mast segment; a projecting stub shaft mounted on said mounting plate; a first roller bearing mounted on said stub shaft; a snap ring placed in a groove on said stub shaft for retainment of said first roller bearing onto said stub shaft; a pair of projecting ears secured to said flat mounting plate; a second roller bearing mounted between said ears by a threaded bolt passing through one of said ears, through said second roller bearing, and into a threaded opening in the other of said ears; said second roller bearing being at right angles to said first roller bearing; a second mast frame segment placed inside said first mast frame segment and being guided for relative movement to said first mast segment by said roller bearing assembly means; and wherein one of the structural end portions of said first lift truck mast frame segments is cut away in order to allow said first roller bearing to be placed into position to contact a first face of said second mast frame segment, and said second roller bearing is placed into a position to contact a second face of said second mast frame segment.

* * * * *